US005080113A

United States Patent [19]

Bui

[11] Patent Number: 5,080,113

[45] Date of Patent: Jan. 14, 1992

[54] WATER PIPE

[76] Inventor: Kim T. Bui, 1591 S.W. 54th Ave., Plantation, Fla. 33317

[21] Appl. No.: 594,074

[22] Filed: Oct. 9, 1990

[51] Int. Cl.[5] ..... A24D 1/14; A24D 1/30

[52] U.S. Cl. ..... 131/173

[58] Field of Search ..... 131/173

[56] References Cited

U.S. PATENT DOCUMENTS 1,545,220 7/1925 Walker ..... 131/173
1,614,903 1/1927 Shakal ..... 131/173
1,690,609 11/1978 Zane ..... 131/173

*Primary Examiner*—V. Millin
*Attorney, Agent, or Firm*—Alvin S. Blum

[57] ABSTRACT

A water pipe has an upper tobacco burning bowl. The bowl is sealed into the top of a water chamber partially filled with water. A first narrow tube sealed into the bottom of the bowl extends below the bowl and into the water. A nipple connected to the side of the water chamber receives a conventional pipe stem or mouthpiece. When the user sucks on the mouthpiece, smoke is pulled down the small tube and bubbles through the water to cool and purify the smoke. A second narrow tube sealed into the nipple extends to the center of the chamber. When the partially filled chamber is tilted or inverted, the two tubes always extend above the water level, preventing loss of water. A small hole in the first tube above the water level prevents water being forced up into the bowl.

4 Claims, 1 Drawing Sheet

WATER PIPE

BACKGROUND OF THE INVENTION

This invention relates to tobacco smoking devices and more particularly to a portable smoking pipe of the type referred to as a water pipe in which smoke is drawn through a liquid before entering the mouth.

The smoke of burning tobacco is harsh, hot and dry. By passing the smoke through a liquid such as water or a sweet oil, the smoke is cooled, various impurities may be removed, and moisture and various aromatic materials may be added to the smoke to enhance the pleasurable effects of smoking. Large water pipes of the prior art are cumbersome to use and carry about.

Portable water pipes have been disclosed. A problem with portable water pipes is that means must be provided to prevent the leakage of water when the pipe is overturned. U.S. Pat. No. 1,545,220 issued 7/7/25 to Walker discloses a complex assembly of multiple, interconnected smoke chambers that is large, expensive to construct, difficult to clean and would not prevent liquid leaking out through the stem. U.S. Pat. No. 1,249,984 issued 12/11/17 to Meissner discloses a water pipe with a brass valve for closing off the stem.

U.S. Pat. Nos. 1,229,943 issued 6/12/17 to Graham et al and 1,428,446 issued 9/5/22 to Milkie disclose portable water pipes without means for preventing water leakage.

SUMMARY OF THE INVENTION

It is accordingly an object of the invention to provide a water pipe for smoking tobacco that can be carried about loaded with liquid that will not leak liquid regardless of pipe orientation. It is another object of the invention to provide such a pipe that is easily disassembled for cleaning and refilling.

It is yet another object to provide such a pipe that is economical to fabricate and that does not require manipulation of valves.

It is yet another object of the invention to provide a pipe that does not draw liquid up from the reservoir into the tobacco.

The pipe of the invention comprises a tobacco bowl for holding the burning tobacco. A small tube depends from, and is in communication with the bottom of the bowl. The small tube is immersed at its lower end in liquid in a liquid chamber. The tobacco bowl is hermetically sealed at its outside diameter into the liquid chamber. An attachment for a pipe stem or mouthpiece is connected to, and communicates with, the liquid chamber through a second small tube that extends part way into the liquid chamber. By extending into the chamber, the open ends of both small tube within the chamber remain above the liquid level regardless of the pipe orientation when the liquid only fills the chamber to an indicated level and the pipe is overturned.

A small hole in the first tube above the liquid level prevents liquid from being forced up into tobacco bowl.

These and other objects, features and advantages of the invention will become more apparent when the detailed description of the invention is read in conjunction with the accompanying drawings.

BRIEF DESCRIPTION OF THE PREFERRED EMBODIMENT

Figure 1:
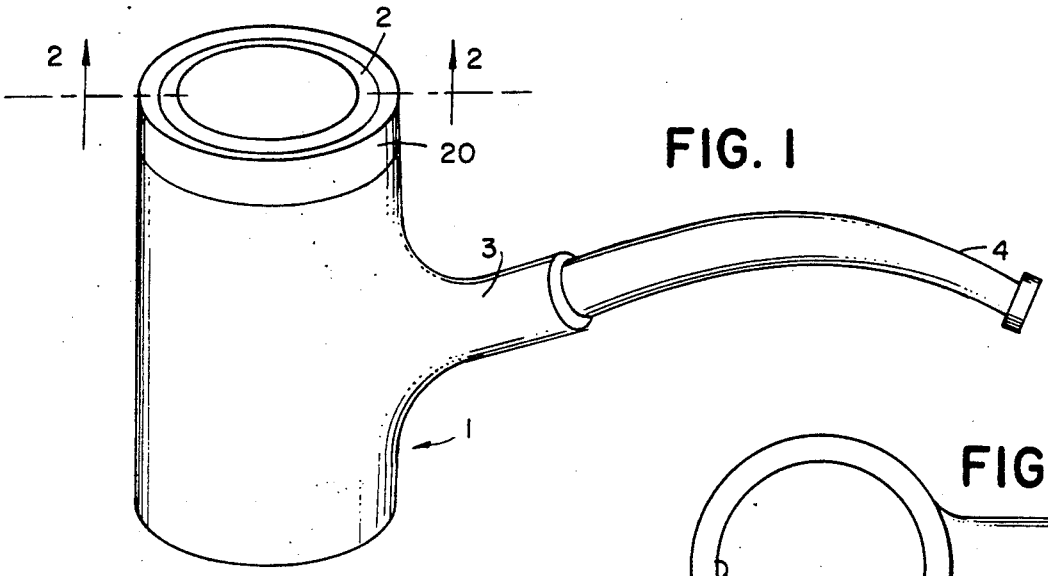
FIG. 1 is a perspective view of the water pipe.
Figure 4:
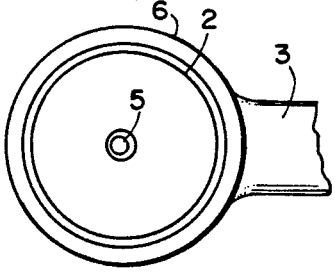
FIG. 4 is a top view of the water pipe.

Referring now first to FIGS. 1 and 4, a portable, spill-proof water pipe 1 is shown with a tobacco bowl 2 having an open top, a hole 5 in the bottom for smoke and made of a material such as briar or meerschaum well known in the art for resistance to burning tobacco. A lateral extension 3 is fitted with a conventional mouthpiece 4. The outward appearance is that of a conventional smoking pipe.

Figure 3:
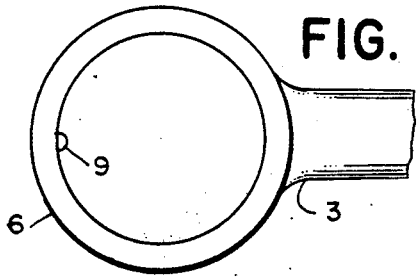
FIG. 3 is a top view of the water chamber.
Figure 2:
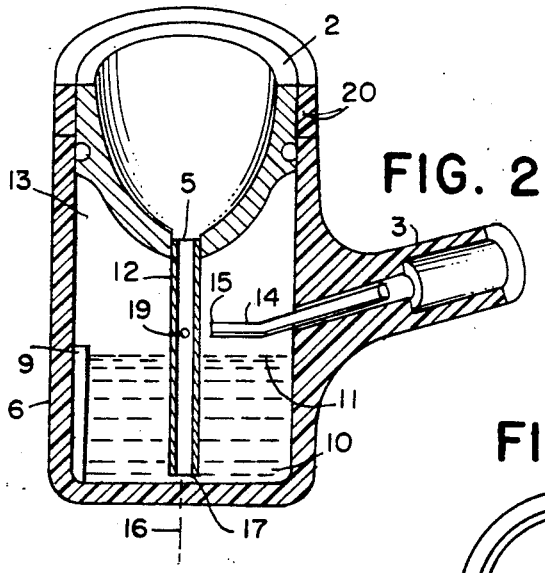
FIG. 2 is a sectional view taken through 2—2 of FIG. 1.
Figure 5:
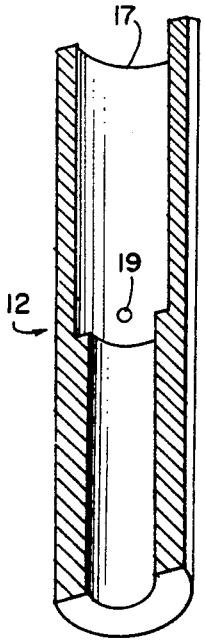
FIG. 5 is a cross sectional view of the vertical tube of FIG. 2.

Referring now to FIGS. 2–4, the tobacco bowl 2 is shown sealed airtight into the top of housing 6 by means of resilient O-ring seal 7. The bowl 2 may be lifted out of the housing for cleaning the housing and filling with liquid 10 up to the level 11 indicated by level indicator 9 which is a vertical ridge along the inner wall of housing 6. A first tube 12 is sealed in communication with hole 5 in the bowl and extends through the liquid downward to a point close to the bottom of the housing. When suction is applied to mouthpiece 4, smoke from the burning leaves is pulled down through first tube 12, bubbles up through the liquid where it is cooled, moistened and purified and any aromatic additives and the like may be added to the smoke. The smoke accumulates in a smoke chamber 13 above the liquid 10 from which it is aspirated through second tube 14 to the mouth of the user. Second tube 14 is sealed into operative communication with lateral extension or stem 3 and has an open end 15 close to the central axis 16 of housing 6 in smoke accumulating chamber 13. When the pipe is inverted or tilted to any angle, the open end 15 of second tube 14 will always remain above the liquid level so that liquid will not leak out the lateral extension 3. When the pipe is inverted so that liquid wets bowl 2, the open end 17 of the first tube 12 will be above the liquid level so that liquid will not pass into the bowl. Certain conditions may tend to force liquid into the bowl when the pipe is upright and in use. When suction is applied to the mouthpiece, pressure in the first tube 12 is reduced. When suction is removed, the smoke chamber 13 returns to atmospheric pressure and, being greater than that in the tube, force liquid up the tube. Furthermore, closing off the mouthpiece with the tongue or blowing into it while talking, for example causes the vapor pressure above the warm liquid to rise above ambient, forcing liquid up the tube to wet and extinguish the tobacco. These problems are overcome by providing a minute vent hole 19 in tube 12 just above the liquid level 11. As shown in FIG. 5, the tube 12 may have a narrower channel in its lower portion to further reduce upward flow of liquid.

For decorative and manufacture advantages, the bowl 2 may have an annular outer ring 20 of a material matching the housing material.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A liquid-cooled, spill-proof smoking device comprising:

A) a housing means for containing a volume of liquid including level indicating means for indicating a liquid level for effective operation without spilling, said housing means having a closed lower end, a central vertical axis, and an open upper end;

B) tobacco bowl means for containing a supply of tobacco for smoking, said bowl means having an open top and a closed bottom end;

C) sealing means for removably sealing said bowl means into said open upper end of said housing means in air-tight connection, thereby forming a closed chamber containing said liquid and a smoke accumulating space above said liquid level;

D) a first tube means enclosed within said chamber and extending vertically substantially along said central vertical axis, said said first tube means being operatively connected at said first end to said closed bottom end of said bowl means and extending vertically downward therefrom through said smoke accumulating space and opening at a point below said liquid level for introducing smoke from said bowl means into said liquid, whereby said smoke passes upward through said liquid and into said smoke accumulating space;

E) an elongate pipe stem means operatively connected to said housing means and projecting outwardly therefrom for withdrawing smoke from said smoke accumulating space, said stem means having an outer end adapted for mouth suction and an inner end in air-tight operative communication with a second tube means arranged for conducting smoke from a point adjacent said axis of said housing within said smoke accumulating space to said outer end, said second tube means having an open end at a point substantially adjacent said central axis;

whereby said device may be turned in any position relative to gravity without loss of said liquid when filled with liquid to said level by means of said first and second tube means opening above said liquid level within said housing means when tilted or inverted.

2. The device according to claim 1 in which said first tube means is provided with a lateral aperture of diameter less than the inside diameter of said first tube means to provide a pressure equalizing vent to said smoke accumulating space to prevent said liquid from entering said bowl means when pressure in said space increases, said aperture extending through a side wall of said first tube means in a direction transverse to said central axis to thereby form a direct gas connection between said smoke accumulating space and the interior of said first tube means above said liquid level.

3. The device according to claim 2 in which said first tube means has a narrower inner diameter at said second end than at said first end to reduce liquid flow therethrough.

4. The device according to claim 2 in which said sealing means includes a resilient ring.

* * * * *